US011206908B2

(12) United States Patent
Murray

(10) Patent No.: US 11,206,908 B2
(45) Date of Patent: Dec. 28, 2021

(54) HAIR TIE EXTRACTION IMPLEMENT

(71) Applicant: Lauren Murray, Lehi, UT (US)

(72) Inventor: Lauren Murray, Lehi, UT (US)

(73) Assignee: Lauren Peterson, Highland, UT (US)

( * ) Notice: Subject to any disclaimer, the term of this patent is extended or adjusted under 35 U.S.C. 154(b) by 0 days.

(21) Appl. No.: 16/442,340

(22) Filed: Jun. 14, 2019

(65) Prior Publication Data

US 2019/0298030 A1 Oct. 3, 2019

Related U.S. Application Data

(63) Continuation-in-part of application No. 15/378,349, filed on Dec. 14, 2016, now abandoned.

(51) Int. Cl.

| | |
|---|---|
| ***A45D 8/00*** | (2006.01) |
| ***A46B 9/02*** | (2006.01) |
| ***A46B 15/00*** | (2006.01) |
| ***B26B 11/00*** | (2006.01) |

(52) U.S. Cl.

CPC ..... *A45D 8/00* (2013.01); *A46B 9/023* (2013.01); *A46B 15/0065* (2013.01); *B26B 11/00* (2013.01); *A45D 8/002* (2021.01); *A46B 2200/104* (2013.01)

(58) Field of Classification Search

CPC ..... A45D 8/00; A45D 2008/002; A45D 8/36; A45D 8/34; A45D 24/00; A45D 24/10; A45D 24/36; A45D 44/00; A45D 2007/005; A46B 9/023; A46B 15/0065; A46B 2200/104; B26B 11/00; B26B 21/42; B26B 13/24

USPC ..... 30/280, 282, 286, 289, 290, 291, 314, 30/317, 34.05

See application file for complete search history.

(56) References Cited

U.S. PATENT DOCUMENTS

| | | | | |
|---|---|---|---|---|
| 2,256,326 | A * | 9/1941 | Quinio | B26B 21/125 30/30 |
| 3,670,733 | A * | 6/1972 | Carlisle | A61B 17/32093 606/172 |
| 5,566,687 | A * | 10/1996 | Trapanovski | A45D 24/10 132/148 |
| 6,182,364 | B1 * | 2/2001 | Reyburn | B26B 5/00 30/2 |
| 6,493,945 | B1 * | 12/2002 | DeRosa | B26B 27/00 30/286 |
| 7,533,595 | B2 * | 5/2009 | Domenico | B26B 3/08 30/286 |
| 7,958,639 | B2 * | 6/2011 | Ireland | B26B 3/08 30/2 |
| 8,539,961 | B2 * | 9/2013 | Gaugler | B26B 21/12 132/213 |
| 9,107,695 | B2 * | 8/2015 | Horton | A61B 17/32093 |
| 2004/0088868 | A1 * | 5/2004 | Fazio | B26B 3/00 30/294 |
| 2005/0193564 | A1 * | 9/2005 | Trbovich, Jr. | B26B 3/00 30/115 |
| 2009/0019700 | A1 * | 1/2009 | Shushan | B26B 21/12 30/31 |

(Continued)

*Primary Examiner* — William V Gilbert
(74) *Attorney, Agent, or Firm* — Miller IP Law

(57) ABSTRACT

A hair tie extraction implement adapted to remove hair ties and/or elastomeric bands entangled with hair from the head of a wearer. The hair tie extraction implement comprises a grippable shank, a hook, a razor blade, and an outwardly rising bill.

19 Claims, 4 Drawing Sheets

(56) References Cited

U.S. PATENT DOCUMENTS

| | | | | |
|---|---|---|---|---|
| 2009/0178268 | A1* | 7/2009 | Domenico | B26B 27/005 29/592 |
| 2010/0236074 | A1* | 9/2010 | Curtin | B26B 9/02 30/121.5 |
| 2013/0327349 | A1* | 12/2013 | Tolman | A45D 8/34 132/200 |

* cited by examiner

HAIR TIE EXTRACTION IMPLEMENT

FIELD OF THE INVENTION

This invention relates to hair ties, and more particularly relates to an implement for extracting a hair tie entangled with the hair of wearer.

BACKGROUND

Description of the Related Art

Hair ties are well-known in the art for styling the hair of younger children and women. Elastomeric bands (i.e., rubber bands), which are often fabricated for application as office supplies, are the cheapest and most commonly used hair ties among children. Guardians, parents, caretakers, and/or the children themselves stretch and twist these elastomeric bands around locks of hair for utilitarian or ornamental function, using the elastomeric bands to form ponytails, buns, braids, and other hairstyles known to those of skill in the art.

Although elastomeric bands are easily manipulated to style hair, they are much less easily extracted from the styled hair. The hair itself becomes entangled with the elastomeric bands and often the elastomeric bands cannot be readily removed by hand without pulling the hair of the wearer, causing children to leave the elastomeric bands in their hair unnecessarily. They hair ties embedded in hair styles eventually pulling large amounts of hair from the scalp when left in place while also causing discomfort.

There exists no means in the art of painlessly extracting elastomeric bands or hair ties from hair. Knifes and scissors are not effective because they cannot be isolated during cutting to the hair tie itself and because they cannot Because the elastomeric bands can be purchased in bulk for very little cost, there is no incentive to preserve them after use for subsequent use. There is a need in the art for an elastomeric band extraction implement adapted to cut and remove elastomeric bands and hair ties from the hair without cutting or damaging the hair itself.

SUMMARY

From the foregoing discussion, it should be apparent that a need exists for a hair tie extraction implement. Beneficially, such a device would overcome inefficiencies with the prior art by providing a hair tie extraction implement which overcomes the difficulties described above.

The present invention has been developed in response to the present state of the art, and in particular, in response to the problems and needs in the art that have not yet been fully solved by currently available apparti. Accordingly, the present invention has been developed to provide a hair tie extraction implement adapted to cut elastomeric bands from hair, the hair tie extraction implement comprising: an elongated grippable shank; a U-shaped hook affixed to the shank having an interior surface, an apex and an exterior surface, the U-shaped hook defining a tapering blade recesses adapted to receive a hair tie; an outwardly rising bill affixed to a terminal end of the hook, the bill adapted to insert into strands of hair; and a polymeric razor blade affixed to the interior surface of the hook, the razor blade oriented such that a sharpened edge faces away from the apex of the hook.

The shank, hook and blade may be formed as a single integrated piece. The hair tie extraction implement may be adapted to be used as a keychain. The hair tie extraction implement may comprise one of titanium, aluminum and steel. A length of the hair tie extraction implement may be less than three inches in some embodiments.

The hair tie extraction implement may further comprise an edge guard disposed above the sharpened edge of the crook. The hair tie extraction implement may further comprise a plurality of protruding bristles forming a brush.

The handle may further comprise a recess for receiving the brush.

The bristles of the handle may cantilever laterally from the handle.

A second hair tie extraction implement adapted to cut elastomeric bands from hair is provided, the hair tie extraction implement comprising: an elongated grippable shank; a U-shaped hook affixed to the shank having an interior surface, an apex and an exterior surface; an outwardly rising bill affixed to a terminal end of the hook, the bill adapted to insert into strands of hair; and a razor blade affixed between to the interior surface of the hook, the razor blade oriented such that a sharpened edge faces away from the apex of the hook; the razor blade forming a chord within a circular shape of the hook.

The shank, blade and hook may be formed as a single integrated piece.

The hair tie extraction implement may be adapted to be used as a keychain.

The hair tie extraction implement may comprise one of titanium, aluminum and steel.

A length of the hair tie extraction implement may be less than three inches.

The hair tie extraction implement may further comprise an edge guard disposed above the sharpened edge of the crook.

The blade may be inwardly-curving, or concave.

A third hair tie extraction implement adapted to cut elastomeric bands from hair is provided, the hair tie extraction implement consisting of: an elongated grippable shank; a plurality of bristles forming a brush, the bristles protruding from the handle; a U-shaped, polymeric hook affixed to the shank having an interior surface, an apex and an exterior surface, the U-shaped hook defining a tapering blade recesses adapted to receive a hair tie; an outwardly rising bill affixed to a terminal end of the hook, the bill adapted to insert into strands of hair; wherein an interior surface of the hook is sharpened to form a blade facing the brush; and wherein the handle, hook, bill and blade are formed as a single integrated, polymeric piece.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
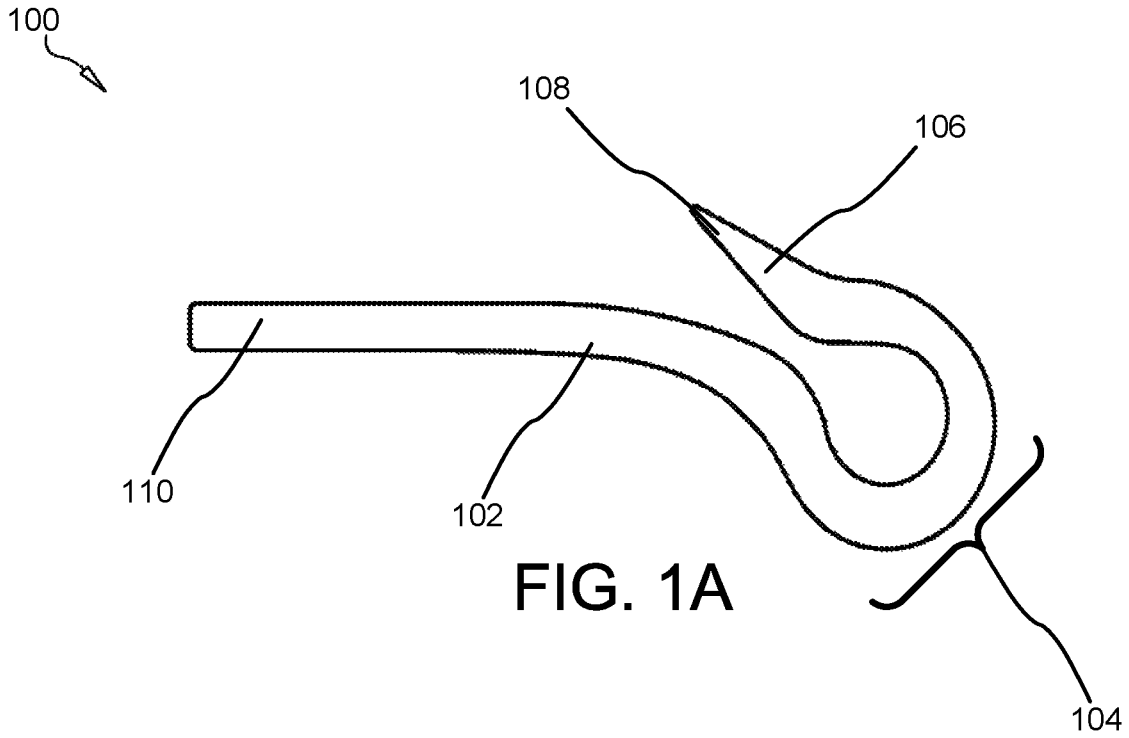
FIG. 1A is a side perspective view of a hair tie extraction implement in accordance with the present invention.

FIG. 1A is a side perspective view of a hair tie extraction implement in accordance with the present invention. The implement 100 comprises a shank 102, a proximal end 110, and a hook 104 comprising an outward bill 106 comprising a tip 108.

The implement 100 is adapted to insert into a lock of hair and separate strands of hair surrounding a hair tie.

The bill 106 is inserted first with the tip 108 leading. The bill 106 protrudes upwardly and outwardly from the hook 104.

The shank 102 and hook 104 may be formed as a single integrated piece. The shank 102 may comprise an elongated cylindrical or tubular metallic, metal alloy, organic or polymeric member. The shank 102 and hook 104 may comprise a pipe, tube shaft, bar, rod or any other component known to those of skill in the art. The shank 102 may comprise an extruded aluminum, steel or titanium rod.

The hook 104 is affixed to the shank 102 such that an opening defined by the hook 104 sits above the shank 102.

Figure 1B:
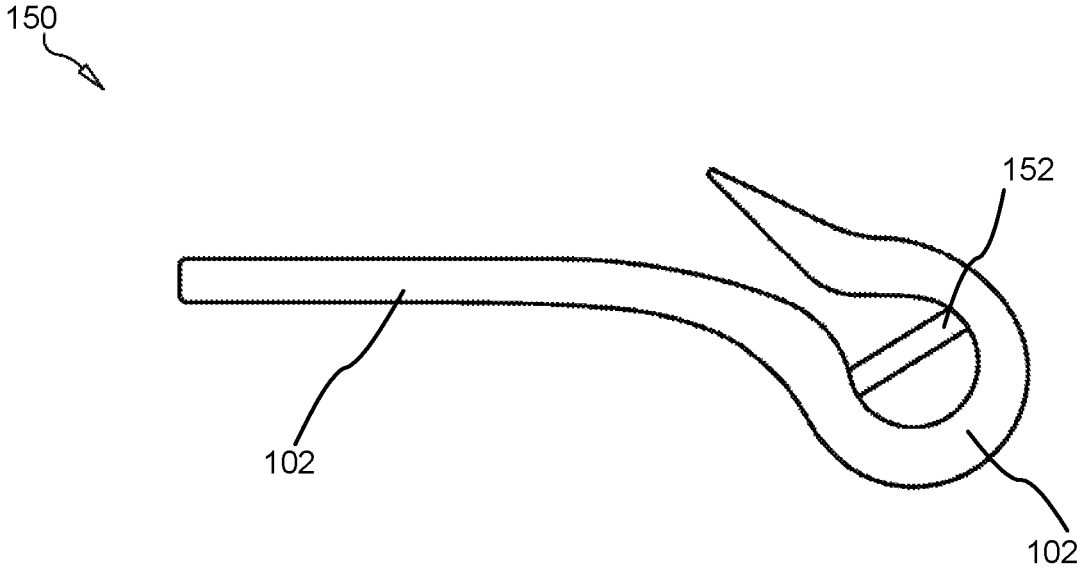
FIG. 1B is a side perspective view of a hair tie extraction implement in accordance with the present invention.

FIG. 1B is a side perspective view of a hair tie extraction implement in accordance with the present invention.

The razor blade 152 is adapted to engage a hair tie and severe it when the implement 100 is pulled or compressive force is applied to the hair tie. The razor blade 152 comprises one or more sharpened edges. At least one of those sharpened edges faces forward toward the proximal end 110 of the implement 150.

Figure 2:
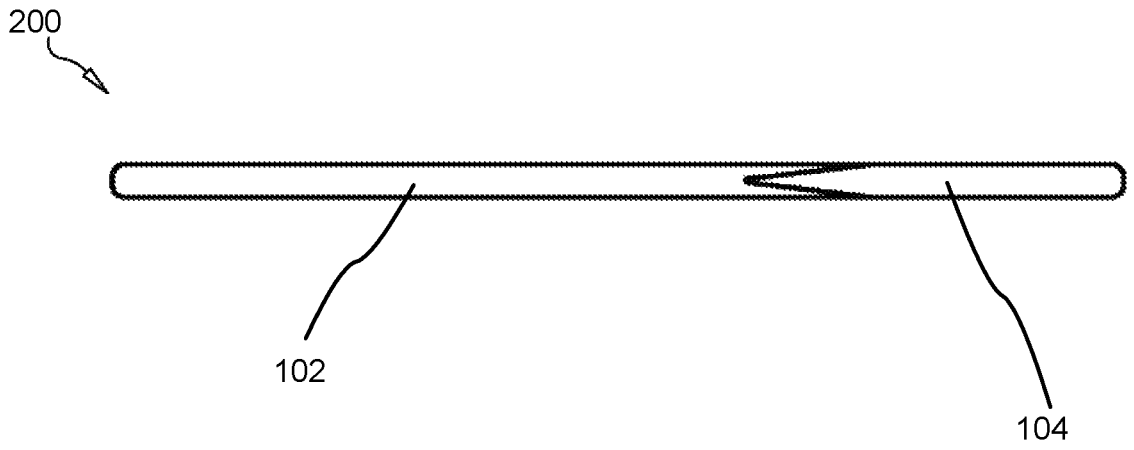
FIG. 2 is a top perspective view of a hair tie extraction implement in accordance with the present invention.

FIG. 2 is a top perspective view of a hair tie extraction implement in accordance with the present invention.

As shown.

Figure 3:
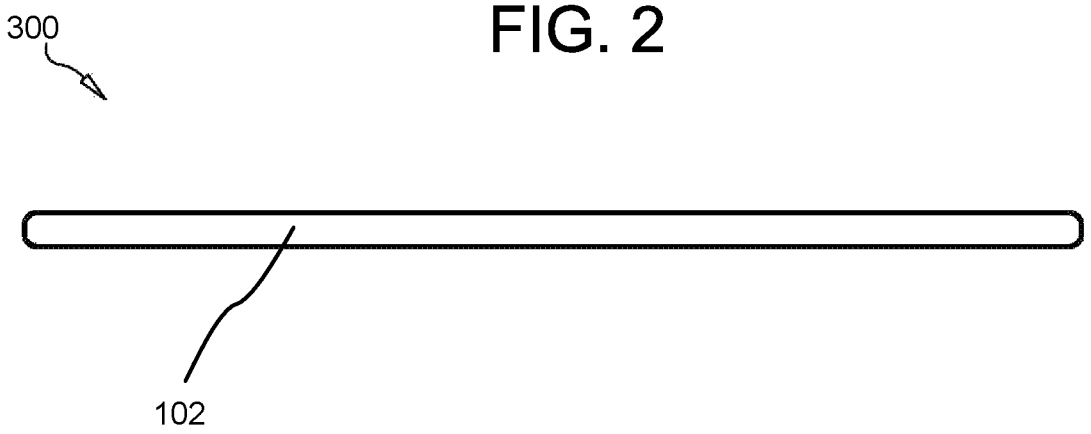
FIG. 3 is a lower perspective view of a hair tie extraction implement in accordance with the present invention.

FIG. 3 is a lower perspective view of a hair tie extraction implement in accordance with the present invention.

As shown.

Figure 4:
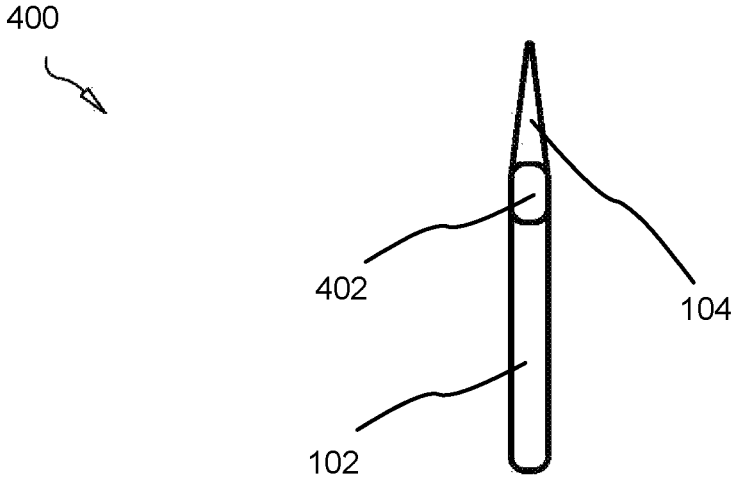
FIG. 4 is a forward perspective view of a hair tie extraction implement in accordance with the present invention.

FIG. 4 is a forward perspective view of a hair tie extraction implement in accordance with the present invention.

The shank 102 must be angled downward from a forward perspective to expose the open hook end 402.

Figure 5A:
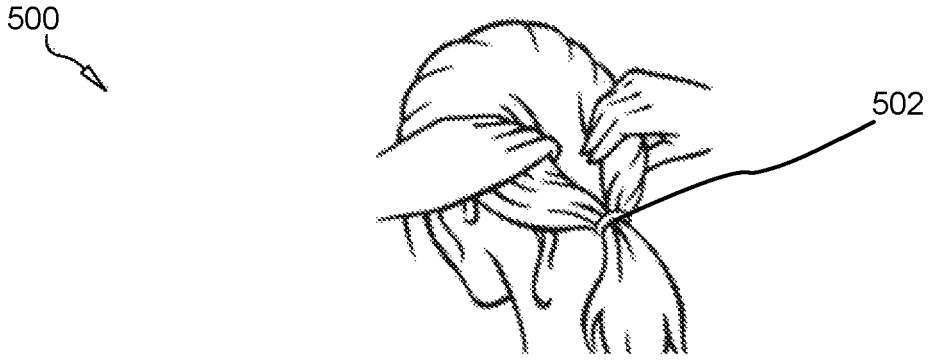
FIG. 5A is an environmental perspective view of a hair tie in accordance with the present invention.

FIG. 5A is an environmental perspective view of a hair tie in accordance with the present invention.

The hair tie 502 may comprise any hair tie known to those of skill in the art, including an elastomeric band ("rubber band").

Figure 5B:
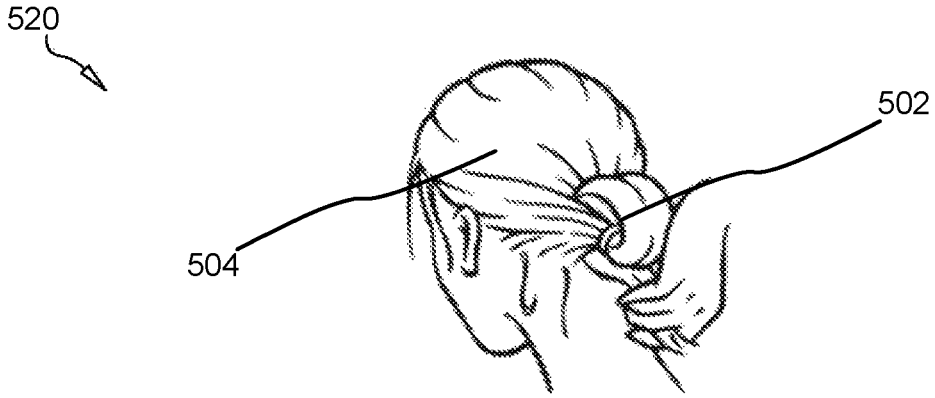
FIG. 5B is an environmental perspective view of a hair tie in accordance with the present invention.

FIG. 5B is an environmental perspective view of a hair tie in accordance with the present invention.

The hair tie 502 may become entangled with surrounding hair when hair is wound over the hair tie 502.

Figure 5C:
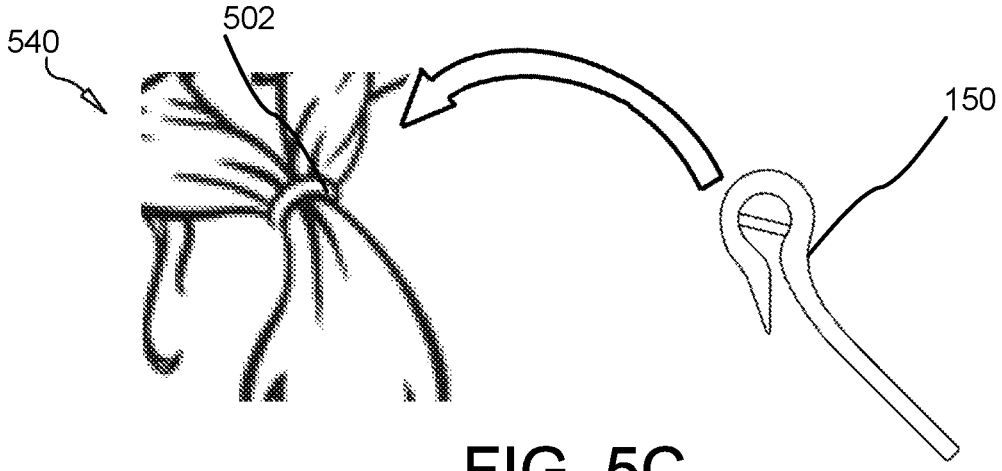
FIG. 5C is an environmental perspective view of a hair tie and hair extraction implement in accordance with the present invention.

FIG. 5C is an environmental perspective view of a hair tie and hair extraction implement in accordance with the present invention.

The bill of the implement 150 is inserted in inverted position into hair 504 above the hair tie 502. The hook of the implement 150 follows the bill into the hair and the hair tie 502 is hooked by the implement than severed by the razor blade housed within the hook when the downward compressive force is applied using the implement 150.

Figure 6:
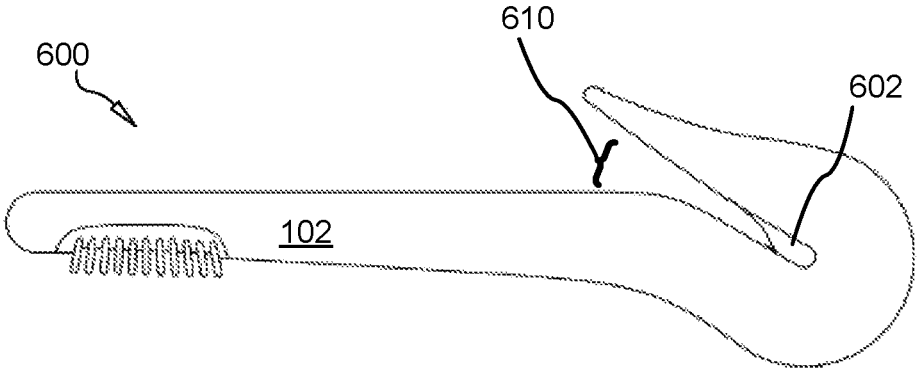
FIG. 6 is a side perspective view of a hair tie extraction implement in accordance with the present invention.

FIG. 6 is a side perspective view of a hair tie extraction implement 600 in accordance with the present invention.

The apparatus 600, as shown, comprises a blade 602 which is concave along its sharpened edge, which edge faces the brush 704 (shown below). The blade 602 is curved inward to allow axial motion of the apparatus 600 with respect to a hair tie, improving cutting function. This curved blade also help prevent injury to small children's fingers which may press through the blade recess 610 and come in contact with the blade 602. The blade recess is between 0.5 and 10 millimeters wide, and tapers toward the blade, reducing in width to 10% to 80% of its original width.

Figure 7:
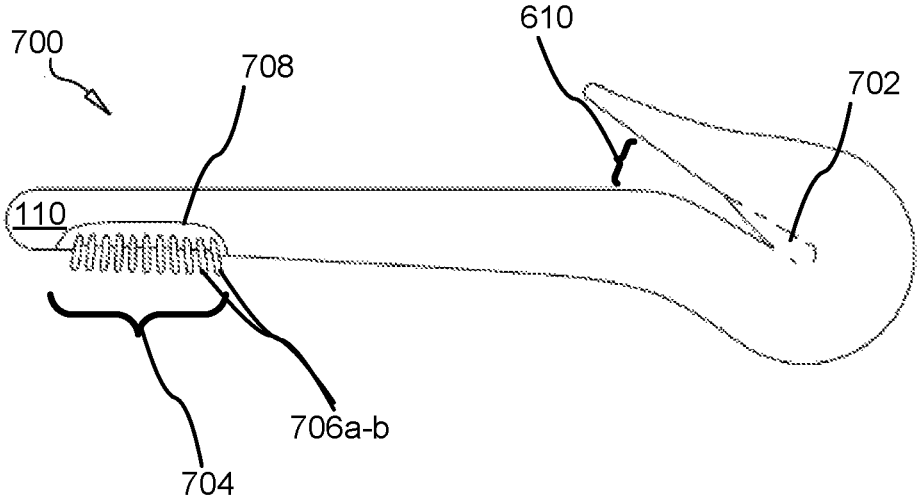
FIG. 7 is a side perspective view of a hair tie extraction implement in accordance with the present invention.

FIG. 7 is a side perspective view of a hair tie extraction implement 700 in accordance with the present invention.

The apparatus 700 has handle 102 and proximal end 110. The handle 102 and/or proximal end 110 define a recess 708 as shown in some embodiments to receive a brush 704 comprising a plurality of protruding rigid bristles 706. The bristles 706 may protrude laterally from the handle 102 as shown, or may protrude superiorly or inferiorly thereto.

In some embodiments, the blade 702 is not made from steel, metal or a metal alloy but rather in fabricated from polymeric materials as the handle 102 and hook 104. The blade 702 may be formed from a hardened plastic which is then sharpened to impart function to the apparatus 700 before being inserted, sharpened after insertion, or formed with a sharpened edge in the mold.

In various embodiments, the blade 702 is formed as a single integrated piece with the handle 102 and hook 104.

Figure 8:
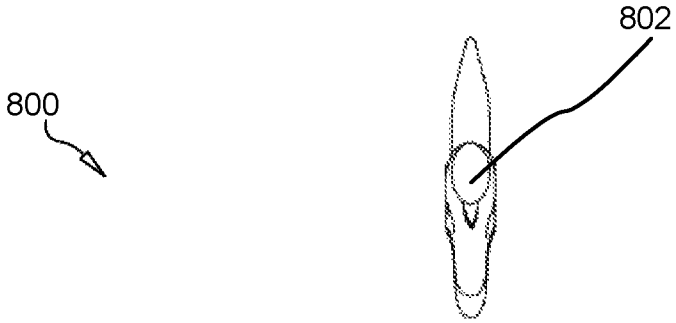
FIG. 8 is a bottom perspective view of a hair tie extraction implement in accordance with the present invention.

FIG. 8 is a bottom perspective view of a hair tie extraction implement 800 in accordance with the present invention.

In various embodiments, the proximal end 110 of the handle 102 is bulbous 802 as shown to facilitate gripping.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:
an elongated grippable shank;
a hook extending from an end of the shank wherein:
the hook comprises an interior surface, a curved apex, and an exterior surface; and
the hook defines a blade recess having a first region and a second region, wherein the first region is defined by a relative angling of the shank relative to the hook to taper the blade recess towards the second region defined by the shank and the hook being approximately parallel to one another proximate the curved apex of the hook, wherein the blade recess is adapted to receive a hair tie;
a bill formed at a terminal end of the hook, wherein:
the bill is adapted to insert between strands of hair;
the bill extends away from the elongated grippable shank and away from the hook such that the bill rises outward from the hook and the elongated grippable shank; and
the bill tapers in width and thickness as the bill extends away from the elongated grippable shank and away from the hook; and
a razor blade affixed to the interior surface of the hook, the razor blade oriented such that a sharpened edge faces away from the curved apex of the hook.

2. The apparatus of claim 1, wherein the shank, hook, and blade are formed as a single integrated piece.

3. The apparatus of claim 1, wherein the shank, the hook, and the blade form a hair tie extraction implement that is adapted to be used as a keychain.

4. The apparatus of claim 1, wherein the shank, the blade, or the hook is formed of:
titanium;
aluminum; or
steel.

5. The apparatus of claim 1, wherein a length of the shank is less than three inches.

6. The apparatus of claim 1, further comprising a plurality of protruding bristles forming a brush disposed on the handle.

7. The apparatus of claim 6, wherein the handle further comprises a recess for receiving the brush.

8. The apparatus of claim 6, wherein the bristles cantilever laterally from the handle.

9. An apparatus, comprising:
a shank;
a hook extending from a first end of the shank, the hook comprising:
a blade recess defined by the hook, the blade recess having a first region and a second region, wherein the first region is defined by a relative angling of the shank relative to the hook to taper the blade recess towards the second region defined by the shank and the hook being approximately parallel to one another proximate the apex of the hook, wherein the blade recess is adapted to receive a hair tie;
an interior surface, an apex, and an exterior surface; and
a bill forming a terminal end of the hook, wherein the bill rises outward from the hook and the shank; and
a razor blade affixed between to the interior surface of the hook, wherein:
the razor blade is oriented such that a sharpened edge of the razor blade faces away from the apex of the hook; and
the razor blade forms a chord within the hook.

10. The apparatus of claim 9, wherein the razor blade forms the chord within the hook such that the razor blade and the interior surface of the hook define an opening.

11. The apparatus of claim 9, wherein a thickness of a segment of material that forms the hook is approximately the same as a thickness of the shank.

12. The apparatus of claim 9, wherein a transition segment between the hook and the bill has a greater width than the hook or the bill such that:
the width of the bill tapers away from the transition segment; and
the width of the hook tapers away from the transition segment.

13. An apparatus, comprising:
a shank;
a plurality of bristles forming a brush, the bristles protruding from the shank;
a hook extending from the shank, the hook having an interior surface, an apex and an exterior surface, and the hook defining a blade recess adapted to receive a hair tie;
a bill that forms a terminal end of the hook, wherein:
the bill rises outward from the hook and the shank; and
the bill is adapted to insert into strands of hair,
wherein:
an interior surface of the hook is sharpened to form a blade facing the brush; and
the handle, the hook, the bill, and the blade are formed as a single integrated, polymeric piece.

14. The apparatus of claim 1, wherein the first region of the blade recess tapers uniformly between the bill and the shank to the apex of the hook.

15. The apparatus of claim 1, wherein:
a segment of the interior surface of the hook is planar along at least one dimension; and a cutting edge of the razor blade forms an acute angle with the segment of the interior surface of the hook that is planar.

16. The apparatus of claim 1, wherein a width of a segment of material that forms the hook is greater than a width of the elongated grippable shank.

17. The apparatus of claim 1, wherein the razor blade is metallic or polymeric.

18. The apparatus of claim 1, wherein the elongated grippable shank tapers in width from the hook to an end of the elongated grippable shank opposite the hook.

19. The apparatus of claim 13, wherein the brush is approximate to an end of the shank opposite the hook.

* * * * *